US006000542A

United States Patent [19]

Smith

[11] Patent Number: 6,000,542

[45] Date of Patent: Dec. 14, 1999

[54] SEAMING IRON HOLDER

[75] Inventor: Joseph C. Smith, 23157 SW. 56th Ave., Boca Raton, Fla. 33433

[73] Assignee: Joseph C. Smith, Boca Raton, Fla.

[21] Appl. No.: 09/048,617

[22] Filed: Mar. 26, 1998

[51] Int. Cl.[6] ..... A45C 11/26

[52] U.S. Cl. ..... 206/349; 206/477; 206/576

[58] Field of Search ..... 206/142, 320, 206/349, 477, 483, 486, 488, 576; 294/149, 151, 52

[56] References Cited

U.S. PATENT DOCUMENTS

| | | | |
|---|---|---|---|
| 1,795,672 | 3/1931 | Plummer | 206/477 |
| 3,968,911 | 7/1976 | Haas | 294/151 |
| 4,526,414 | 7/1985 | Jones | 294/149 |
| 4,570,792 | 2/1986 | Conway | 206/349 |
| 5,127,519 | 7/1992 | Tsao | 206/142 |
| 5,232,258 | 8/1993 | Rossi | 294/152 |
| 5,409,282 | 4/1995 | Bale | 294/152 |

*Primary Examiner*—David T. Fidei

[57] ABSTRACT

The present invention is a seaming iron holder as used in the carpet installation industry. The invention totes the seaming iron and can be used during the seaming process. The holder is preferably made of a material which is flexible enough to lay flat, defining a surface above which the seaming is place intermittently during seaming, while also allowing said surface to be wrapped up around the seaming iron. Said surface then joining together at predetermined edges and defining a holder to tote said seaming iron from job to job.

13 Claims, 2 Drawing Sheets

SEAMING IRON HOLDER

BACKGROUND OF THE INVENTION

1. Field of the Invention

The present invention relates to a holding device to be used in the field of carpet installation. More specifically, said holding device to be used to hold a seaming iron for; transporting to job; holding iron while not in use; holding iron while hot and in usage; and, holding iron after usage while cooling down.

2. Description of the Prior Art

The use of bags to hold tools has been known for many years. Such bags have been used to transport, organize, protect, and otherwise tote tools to and from specific jobs or work areas. To date no bags have been invented which are effective in transporting a seaming iron as used in the carpeting industry. The seaming iron presents specific difficulties in transporting, which other tools do not present. These specific problems include, the size of the seaming iron, the material that the seaming iron comes in contact with, and the extreme temperature that the seaming iron operates at.

In the past, tool bags or holders, were primarily concerned with fitting the tool in a convenient carrying compartment. However, such bags lacked in the ability to efficiently and conveniently carry a seaming iron as used in the carpeting industry.

A seaming iron is bulky and has a permanently attached power cord that allows it to be heated. The seaming iron's size and attached power cord do not allow convenient storage in a conventional tool box or tool bag. Therefore, it is necessary to design a tool bag specifically planned to accommodate a seaming iron.

Moreover, the seaming iron, as used in the carpeting industry, comes into continual contact with adhesive. The adhesive remains on the seaming iron, which causes problems when placing the seaming iron in a bag or holder with other tools. Therefore, it is also advantageous to have a bag or holder that holds only the seaming iron. This eliminates prior tool bags or holders as a good source for holding seaming irons because they are designed to hold multiple tools. None of the prior art in the tool bag or holder fields addresses a bag or holder specifically designed to hold only a seaming iron.

In addition, the contact with an adhesive makes the seaming iron difficult to temporarily store while carpet seaming is taking place. In other words, when a carpet installation technician is making a seam he may have to place the seaming iron down from time to time in order to perform other tasks associated with the installation of the carpet. If a bag or holder was designed so that the seaming iron could conveniently be placed in or on the bag temporarily while in use the bag would be very advantageous. However, no such bag or holder presently exist. Therefore, carpet installation technicians currently place the seaming iron on cardboard temporarily while in use.

Past bags or holders have been constructed of materials that are not sufficient in carrying a tool within extremely hot surface. Many times the seaming iron is still very hot when it is time to leave a job site or carpet seaming has been completed. Therefore, the prior materials, such as plastic and metal would either melt or the tool box would become extremely hot if the seaming iron came in direct contact with the tool box wall. Therefore, none of the prior tool bags or tool holders are adequate for carrying a seaming iron.

There are no patents addressing a device for holding a carpet installation seaming iron. In related areas there are various bags and tool holders, however these patents do not and cannot resolve some of the problems addressed by the present invention. Even thought, the present invention addresses some of the same difficulties experienced in the art as does the prior patents, it does so in a new an inventive way. Moreover, the present invention embodies advantages never found or contemplated by the prior art which are described in greater detail below.

SUMMARY OF THE INVENTION

The use of tool holders or bags is well known. In fact the use of tool holders or bags is well known in the field of carpet installation. To date many of these holders or bags are used to tote and organize a group of tools associated with a certain type task or job. The holders or bags are also used as a convenient way to move tools from one job site to the next.

Within the field of carpet installation there is a special tool or device used to seam two pieces of carpet together. This device is called a seaming iron. The seaming iron is much like a conventional iron in that it is heated up and run over a surface. In this case the surface is seaming tape which is place on the backing of carpet where two pieces meet or join. The heat from the seaming iron activates the adhesive on the seaming tape. At this point the adhesive becomes viscus and steps into the carpet backing to joint the two pieces of carpet and the seaming tape. Thus the carpet is now joined on the back and may be installed on a floor.

The special tool faces a number of unique problems. First, the size of the tool and attached power cord make it awkward to place in a conventional tool box. Second, the nature of the tool's use makes adhesive stick to it. This adhesive can then transfer to other tools it may come in contact with or to the tool holder or bag it is placed in. Third, the seaming iron is often hot during use and after use, and a convention holder or bag may be ill equipt to handle such elevated temperature. Therefore, it is desirable to have the best possible holder or bag to transport and hold during and after use a seaming iron as used in the carpet installation field. It is the object of this invention to provide a holder or bag for a seaming iron that overcomes the limitations and faults of current holders and bags when used to carry a carpet installation seaming iron.

Another primary object of the invention is to allow a carpet installation technician to use the holder or bag during carpet seaming as a place to conveniently place the hot and adhesive covered seaming iron. Currently technicians typically use a piece of cardboard which can cause problems such as an accidental burning of the carpets top surface or adhesive being transferred to the carpet top surface. However, with the present invention the seaming iron could be placed on a secure surface.

It is still another object of this invention to provide a cost effective means of providing a holder or bag for the seaming iron. Due to the nature of the task that the seaming iron performs, a holder or bag will degrade with use and become not usable over time. Therefore, it is important that materials that are task effective as well as cost effective be used in the construction of the seaming iron bag or holder. As seen herein the material selection for the present invention is only limited by a few specific performance criteria but in the preferred embodiment of the invention material cost is also selection criteria.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
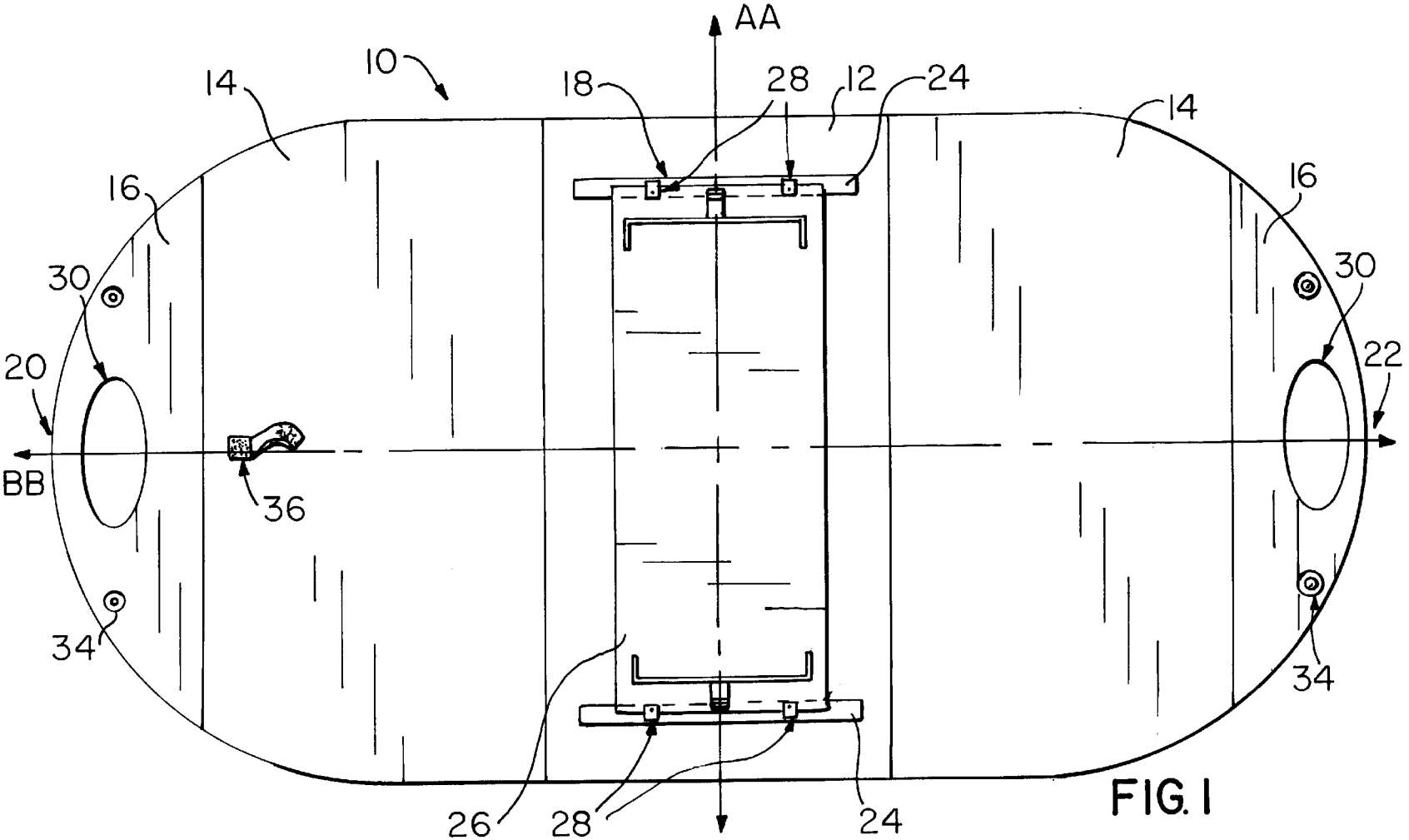
FIG. 1. represents the seaming iron bag or holder top view when the seaming iron bag or holder is opened and laid flat.
Figure 3:
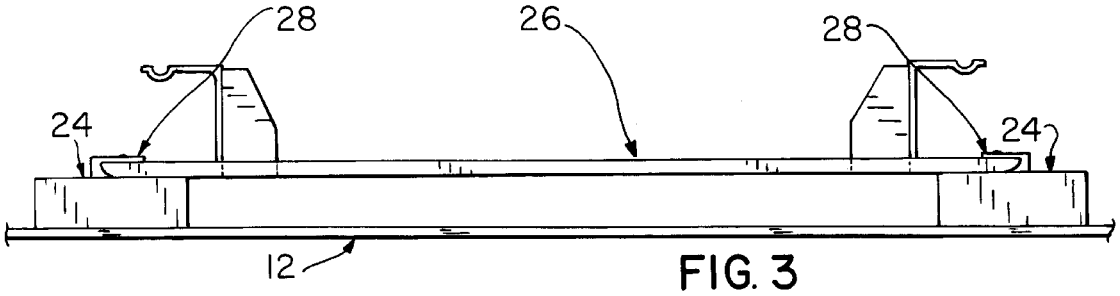
FIG. 3. represents a side view of a seaming iron mount contained with the seaming iron bag or holder.
Figure 2:
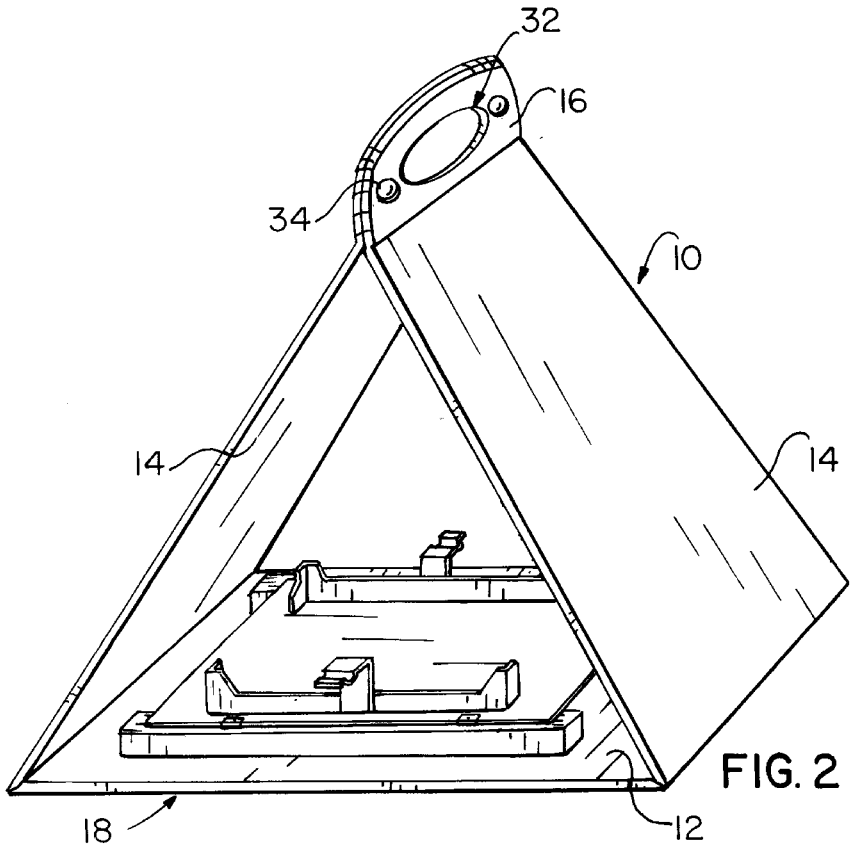
FIG. 2. represents a three dimensional drawing of the seaming iron bag or holder when it is folded and a handle section is snapped together.

As seen in FIGS. 1, 2 and 3 the preferred embodiment of the present invention comprises Flexible Housing (10), Flexible Housing (10) further comprising First Section (12), attached to First Section (10) are Pair of Second Sections (14) and attached to Pair of Second Sections (12) are Pair of Third Sections (16). Contained within Flexible Housing (10) is Seaming Iron Mount (18). Seaming Iron Mount (18) secures a Seaming Iron within Flexible Housing (10). The seaming iron is used in the industry of carpet installation and the seaming iron is not claimed as part of the present invention.

In the preferred embodiment Flexible Housing (10) is substantially symmetrical about the vertical axis AA of FIG. 1 and horizontal axis BB of FIG. 1. First Section (12) is substantially centered around axis AA of FIG. 1. Extending axially outward from axis AA of FIG. 1 and attached to First Section (12) on opposite ends are Pair of Second Sections (14). Extending further axially outward along axis AA of FIG. 1 and connected to Pair of Second Sections (14) are Pair of Third Sections (16). First Section (10), Pair of Second Sections (12) and Pair of Third Sections (14) comprise Flexible Housing (10) so that First End (20) of Flexible Housing (10) can be brought around axis BB of FIG. 1 and Second End (22) can be brought around axis BB of FIG. 1 and First End (20) and Second End (22) may be joined to form Flexible Housing (10) as shown in FIG. 2.

Contained within Flexible Housing (10) is Seaming Iron Mount (18). In the preferred embodiment Seaming Iron Mount (18) is attached to First Section (12) so that when First End (20) and Second End (22) are joined and define an interior of Flexible Housing (10), Seaming Iron Holder is contained within the interior of Flexible Housing (10) as shown in FIG. 2. Moreover, Seaming Iron Mount(18) is substantially centered about axes AA and BB of FIG. 1.

Seaming Iron Mount(18) is attached to First Section (12) by Pair of Spacer Blocks (24). Connected to Pair of Spacer Blocks (24) is Seaming Iron Mount Plate (26). Pair of Spacer Blocks (24) are required to define an air space between Seaming Iron Mount Plate (26) and First Section (12) so that heat from the mounted seaming iron may be dissipated and not compromise the material of First Section (12). Connected to Seaming Iron Mount Plate (26) are a pair of Seaming Iron Clamps (28). Seaming Iron Clamps (28) are connected to Seaming Iron Mount Plate (26) on an opposite surface from which Seaming Iron Mount Plate (26) is connected to Pair of Spacer Blocks (24) and a second air space between Seaming Iron Clamps (28) and Seaming Iron Mount Plate (26) is defined so that heat from the seaming iron can be further dissipated and any material falling from the seaming iron, such as adhesive type material, may be caught by Seaming Iron Mount Plate (26). Seaming Iron Mount (18) is mounted so that when First End (20) and Second End (22) are joined the seaming iron can be held on Seaming Iron Mount (18) within Flexible Housing (10).

As Seen in FIGS. 1 and 2, the surfaces of Pair of Third Sections (16) define identical Orifices (30). Orifices (30) are positioned so that when First End (20) and Second End (22) are brought toward each other Orifices (30) align to form Joined Orifice (32) which defines a handle. In addition, Pair of Third Sections (16) have a joining means. In the preferred embodiment Pair of Snaps (34) are placed on Pair of Third Sections (16) as shown in FIGS. 1 and 2.

In the preferred embodiment Velcro® Loop (36) is attached to one of Second Pair of Surfaces (14) so that when First End (20) and Second End (22) are joined Velcro® Loop (36) is within Flexible Housing (10). Velcro® Loop (36) is used to hold the power cord of the seaming iron within Flexible Housing (10) when Flexible Housing (10) is used to transport the seaming iron, but the seaming iron's power cord is not claim as part of the present invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A seaming iron holder further comprising;

a flexible housing having an inner surface and an outer surface and a first end and a second end, said flexible housing made of material which is flexible enough to lay flat, or be folded with said first end being brought to said second end, to form an interior to said flexible housing; and, a seaming iron mount means for mounting a seaming iron above the inner surface of the flexible housing while providing a gap between the seaming iron mount means and the inner surface of the flexible housing.

2. A seaming iron holder as described in claim 1 wherein the flexible housing further comprises a first section in the flexible housing center, the first section having a first end and a second end, a pair of second sections having one of the pair of second sections connected to the first end of the first section and having the other of the second sections connected to the second end of the first section.

3. A seaming iron holder as described in claim 2 wherein the flexible housing further comprises a pair of third sections, one of the pair of third sections being connected to one of the pair of second section on a second section end opposite the connection between the first section and the second section and having the other pair of third sections connected to the other one of the pair of second surfaces opposite the connection between the first section and the other second section.

4. A seaming iron holder as described in claim 3 wherein the seaming iron mount is attached to the first section.

5. A seaming iron holder as described in claim 4 wherein the seaming iron mount further comprises a pair of spacer blocks between the seaming iron mount and the first section.

6. A seaming iron holder as described in claim 5 wherein the seaming iron mount further comprises a seaming iron mount plate attached to the spacer blocks.

7. A seaming iron holder as described in claim 6 wherein the seaming iron mount further comprises a pair of seaming iron clamps connected to the seaming iron plate.

8. A seaming iron holder as described in claim 3 wherein the seaming iron holder further comprises a means for joining the pair of third sections when the first end and the second end of the flexible housing are brought together and form the interior of the flexible housing.

9. A seaming iron holder as described in claim 8 wherein the joining means are a pair of snaps.

10. A seaming iron holder as described in claim 4 wherein each one of the third sections further define orifices that define a handle when the first end and the second end of the flexible housing are brought together to form the interior of the flexible housing.

11. A seaming iron holder as described in claim 10 having a power cord securing means mounted to said housing for securing said seaming iron's power cord.

12. A seaming iron holder as described in claim 11 wherein the flexible housing is made of vinyl.

13. A seaming iron holder further comprising;

a flexible housing having an inner surface and an outer surface and a first end and a second end, said flexible housing made of material which is flexible enough to lay flat, or be folded with said first end being brought to said second end, to form an interior to said flexible housing, the flexible housing having a first section at the flexible housing center, the first section having a first end and a second end, the flexible housing having a pair of second sections having one of the pair of second sections connected to the first end of the first section and having the other of the second sections connected to the second end of the first section, the flexible housing having a pair of third sections, one of the pair of third sections being connected to one of the pair of second section at a second section end opposite the connection between the first section and the second section and having the other pair of third sections connected to the other one of the pair of second surfaces opposite the connection between the first section and the other second section, the seaming iron holder further comprises a means for joining the pair of third sections when the first end and the second end of the flexible housing are brought together and form the interior of the flexible housing, the joining means are a pair of snaps, each of the third sections further define orifices that define a handle when the first end and the second end of the flexible housing are brought together to form the interior of the flexible housing, the seaming iron holder further comprises a means for holding said seaming iron's power cord, said means for holding is mounted on the interior surface of the flexible housing, and the seaming iron holder is made of vinyl; and, a seaming iron mount in connection with the interior surface of said flexible housing, the seaming iron mount is attached to the first section, the seaming iron mount further comprises a pair of spacer blocks between the seaming iron mount and the first section of the seaming iron holder, the seaming iron mount further comprising a seaming iron holder plate attached to the spacer blocks, the seaming iron mount further comprises a pair of seaming iron clamps connected to the seaming iron plate.

* * * * *